United States Patent [19]

Kennedy et al.

[11] 4,409,953

[45] Oct. 18, 1983

[54] SPRING TYPE BALL PITCHING MACHINE

[75] Inventors: Melvin R. Kennedy, Hampton Bays, N.Y.; Dietmar Nagel, Chester, N.J.

[73] Assignee: Nagel, Kennedy, Arad & Associates, New York, N.Y.

[21] Appl. No.: 238,591

[22] Filed: Feb. 26, 1981

[51] Int. Cl.[3] ..... A41B 7/00

[52] U.S. Cl. ..... 124/7; 124/41 R; 124/36; 124/50

[58] Field of Search ..... 124/16, 17, 36, 32, 124/41 R, 50, 7, 86, 49, 51–53, 9; 273/26 D; 198/638, 639

[56] References Cited

U.S. PATENT DOCUMENTS

| | | | |
|---|---|---|---|
| 2,700,379 | 1/1955 | Brigati | 124/50 |
| 3,252,453 | 5/1966 | Giovagnoli | 124/36 |
| 3,470,859 | 10/1969 | Ponza | 124/50 |
| 3,640,262 | 2/1972 | Hunsicker | 124/36 X |
| 3,831,933 | 8/1974 | Fantozzi | 221/17 X |
| 3,867,921 | 2/1975 | Politzer | 124/36 |
| 4,209,004 | 6/1980 | Kennedy | 124/50 X |

*Primary Examiner*—Richard C. Pinkham
*Assistant Examiner*—William R. Browne
*Attorney, Agent, or Firm*—Amster, Rothstein & Engelberg

[57] ABSTRACT

A toy baseball pitching machine that is particularly adapted to be used by children. The machine has a ball pitching arm that oscillates rather than rotates and is capable of pitching a plastic ball to a batter using an "underhand" method of pitching. The ball pitching arm is fixed to an oscillatable eccentric arm. The eccentric arm is connected to one end of an extension spring, and the arm carries a pivoted pawl. The pawl is engaged by a toothed rotating drive wheel to rotate the pitching arm in one direction toward a cocked position with the spring extended. Further rotation of the drive wheel brings the pawl into contact with a stop to pivot the pawl out of engagement with the drive wheel. The extended spring then acts on the eccentric arm and pitching arm to rotate the pitching arm in the opposite direction to engage and pitch a ball. The drive wheel, pawl, eccentric arm, stop and extension spring are all mounted within a housing; and the pitching arm is outside the housing. The machine has a ball storage rack so it is capable of pitching a plurality of balls and is battery powered and includes an automatic shut-off switch, which shuts the pitching machine off when all balls are pitched.

8 Claims, 7 Drawing Figures

FIG. 4.
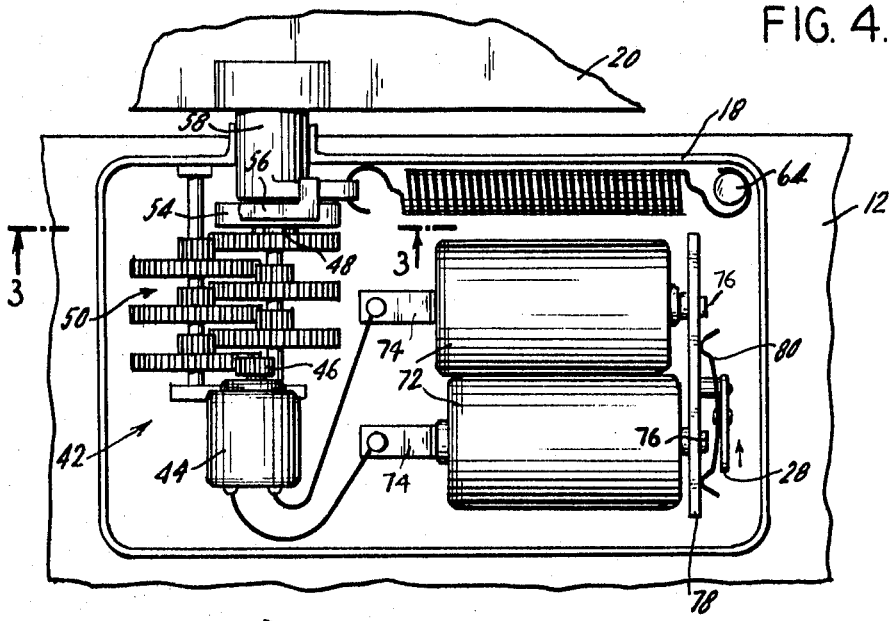
FIG. 5.
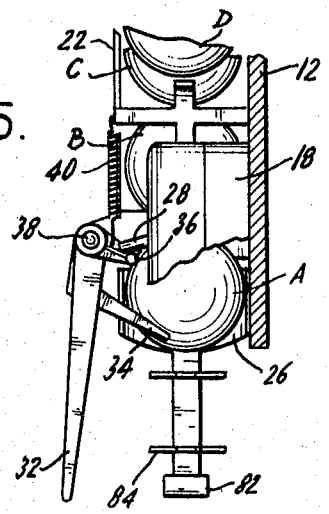
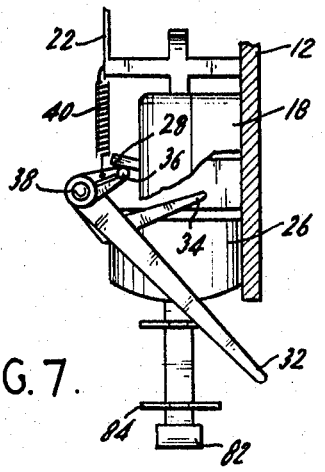
FIG. 7.
FIG. 6.
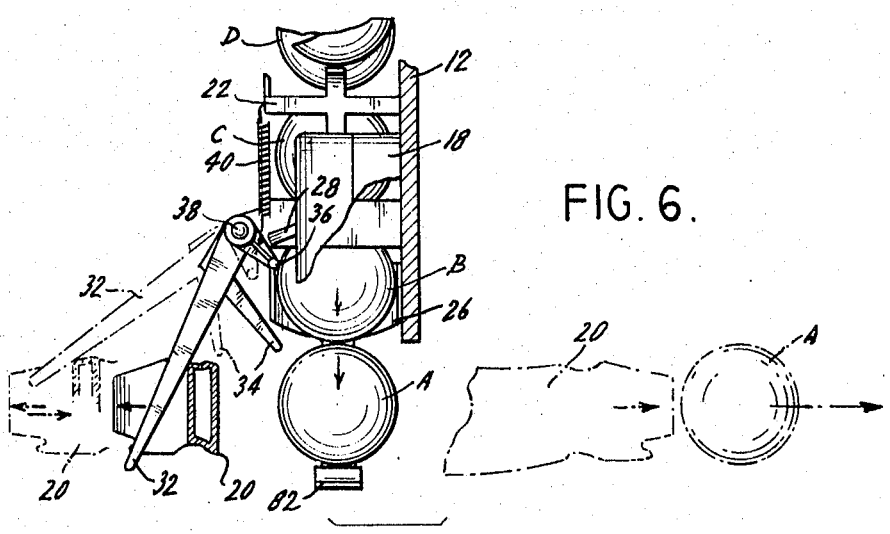

SPRING TYPE BALL PITCHING MACHINE

The present invention relates to toy baseball pitching machines for use in conjunction with plastic balls. The pitching machine is specifically adapted to throw the light-weight, plastic "baseball" to a batter by the use of an underhand pitching motion whereby the pitching arm reciprocates rather than rotates.

Prior art baseball pitching machines such as the machine disclosed in U.S. Pat. No. 2,877,757 to Giovagnoli, are large, complex, and necessarily quite expensive. Therefore, such apparatus would not be suitable for use as a toy. The pitching machine disclosed in U.S. Pat. No. 3,511,225 to Yokoi, although small in size and simple, is not capable of throwing regulation-size baseballs. Furthermore, the Yokoi machine contains a rotating pitching arm and a rotating mechanism that is mounted externally. Therefore, although designed for children, the Yokoi machine is not truly suitable for unsupervised use.

The pitching machine disclosed in U.S. Pat. No. 2,655,908 to Calleo is also not suited for use as a toy by children. This machine utilizes a conventional electric motor and, like the machine of Giovagnoli, is not adaptable to be battery operated. The pitching machines of both Calleo and Giovagnoli are constructed to be plugged into conventional line current and will operate continuously without regard to whether there are additional balls to be thrown until the machines are manually turned off.

The ball pitching machine of U.S. Pat. No. 4,209,004 to Kennedy, although small in size, simple, capable of throwing regulation size baseballs and adapted to be operated by a battery powered electric motor, is less desirable than the present invention since it utilizes an overhand pitching motion which requires the ball pitching arm to rotate through a 360 degree arc for every ball that is pitched. Such machine therefore, requires guards around the pitching arm.

The present invention relates to a toy ball pitching machine that overcomes these and other shortcomings of the prior art and is particularly suitable for use by children. Thus, it is a primary object of the present invention to provide a toy ball pitching machine that propels a light-weight, plastic baseball by an underhand pitching motion provided by a reciprocating pitching arm moving through a limit arc.

It is a further object of the present invention to provide a toy ball pitching machine capable of pitching a plurality of balls by utilizing an automatic ball feeding means which will automatically shut itself off to conserve battery power when all the balls have been thrown.

It is a still further object of this invention to provide a toy ball pitching machine that, by virtue of its reciprocating ball pitching arm, that reciprocates through an arc of only approximately 90 degrees, requires no guard rail.

It is a still further object of the present invention to provide a toy ball pitching machine that conserves electrical power by incorporating a drive mechanism that causes the ball pitching arm to reciprocate more than once for each revolution of the drive means.

It is a still further object of the present invention to provide a toy ball pitching machine that has a completely enclosed drive mechanism that can be safely operated by children.

It is a still further object of the present invention to provide a toy ball pitching machine that can be readily manufactured from molded plastic or other similar materials yet can be formed in a pleasing and attractive shape.

In accordance with an illustrative embodiment demonstrating objects and features of the present invention, there is provided a ball pitching machine which includes a frame with a drive housing fixedly mounted on the frame. Reciprocating drive means project from the drive housing and a ball pitching arm, movable between a first released position and a second cocked position to an arc of approximately 90 degrees, is mounted to the drive means. The reciprocating drive means includes means wholly within the drive housing for reciprocating the ball pitching arm comprising the rotating drive or ratchet wheel, an eccentric arm mounted to the ball pitching arm and a pawl pivotably mounted to the eccentric arm engagable with the rotating drive wheel. A release wall is mounted in the housing in operative relationship to the pawl and an extension spring connects the drive housing to the eccentric arm so that the spring will rapidly urge the ball pitching arm backward from the second cocked position to the first released position. The reciprocating drive means is constructed and arranged so that rotation of the drive wheel causes the pawl and the eccentric to move from a first release position to a second cocked position and upon engagement of the pawl with the release wall, the pawl disengages from the drive wheel and the extension spring rapidly rotates the ball pitching arm backward from the second cocked position to the first release position thereby causing the ball to be pitched.

The present invention also provides a ball-pitching machine adapted to pitch at least two balls having a frame including a ball storage rack and a drive housing fixedly mounted on the frame. A reciprocating ball-pitching arm is mounted to the drive housing reciprocating between a first released position and a second cocked position by ball pitching drive means mounted to the frame. An electric motor means engages the drive means and is provided with power means associated with the electric motor. Switch means interruptably connect the power means to the electric motor. A ball storage rack is mounted to the frame and a ball restraining means is provided in operative relationship thereto comprising a reciprocating spider having an actuating arm engageable with the ball pitching arm, a ball restraining arm engageable with the ball in a ball storage rack and a switch engaging arm in operative relationship with the switch means which is responsive to the presence of a ball in the ball storage rack.

The above descriptions, as well as further objects, features and advantages of the present invention will be more fully understood by reference to the following detailed description of the presently preferred, but nonetheless illustrative embodiment in accordance with the present invention, when taken in conjunction with the accompanyng drawings, wherein:

FIG. 4 is a side elevational view of the drive housing with the cover removed;

FIG. 5 is a partial sectional view taken along the line 5—5 in FIG. 1, looking in the direction of the arrow when the ball pitching arm (not shown) is in the released position;

FIG. 6 is a partial sectional view similar to FIG. 5 with the ball pitching arm approaching the cocked position;

FIG. 7 is a partial sectional view similar to FIGS. 5 and 6 when the ball pitching arm (not shown) has been released and no additional balls are in the ball storage rack.

Figure 1:
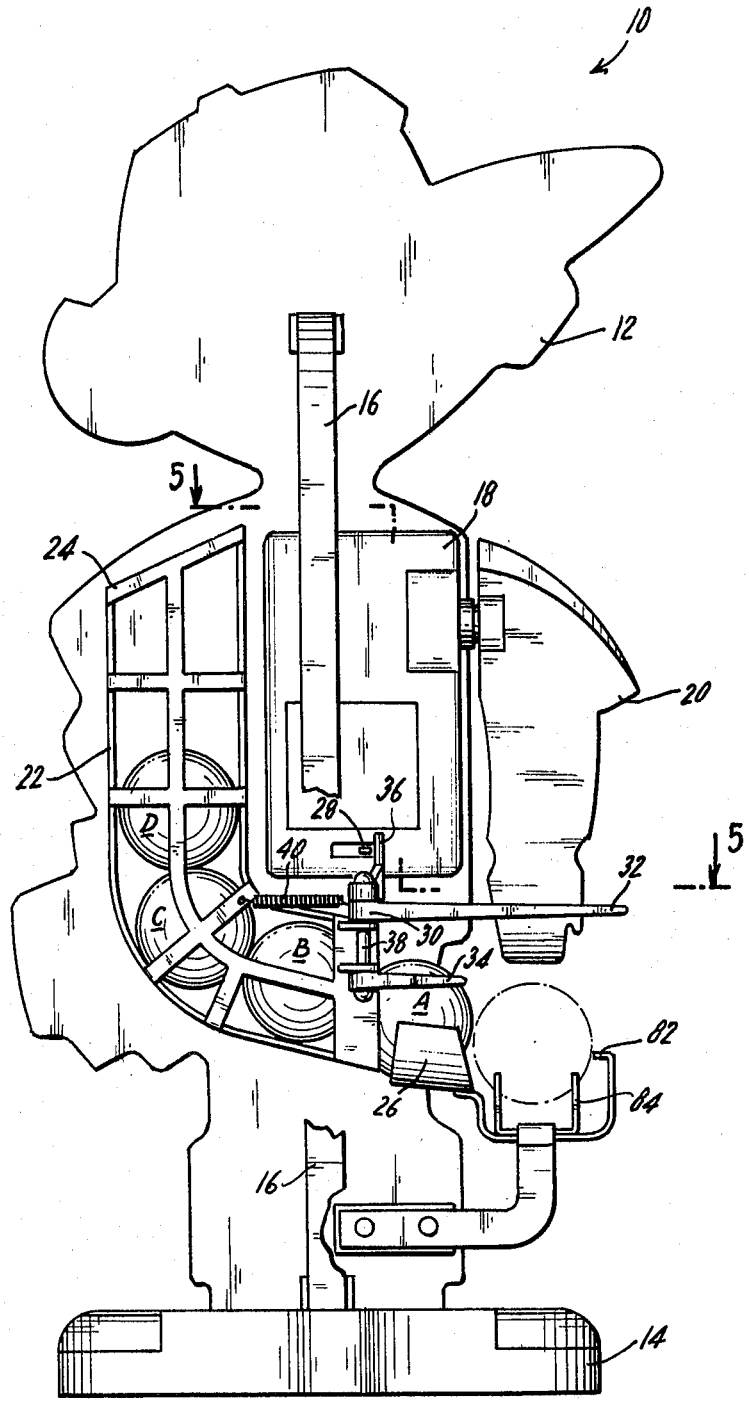
FIG. 1 is a back elevational view of the ball pitching machine of the present invention.
Figure 2:
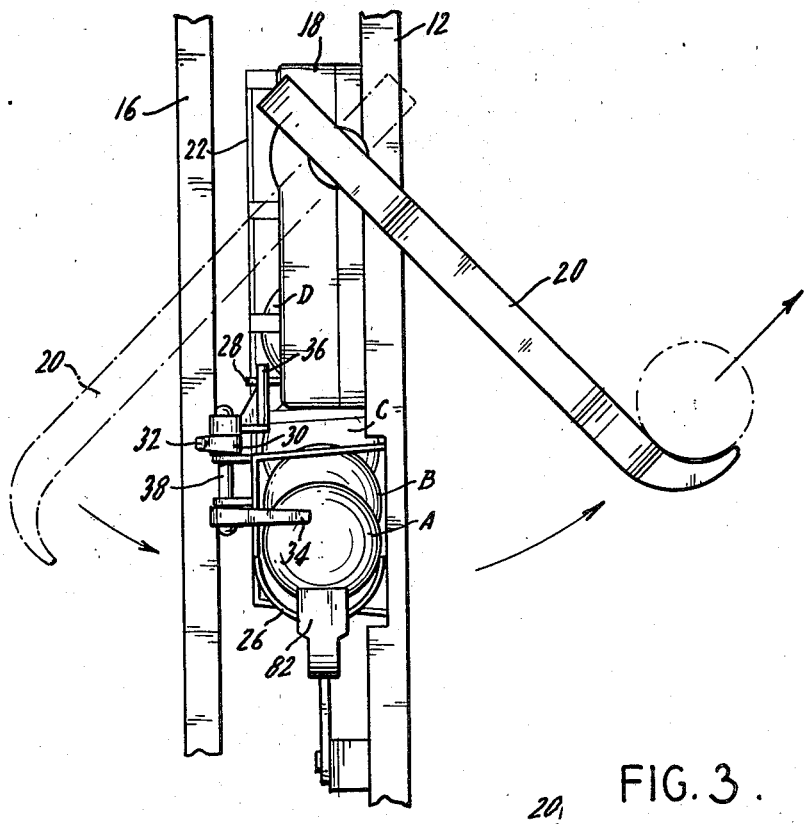
FIG. 2 is a partial side-view showing the ball pitching arm.

Referring now specifically to the drawings and in particular to FIG. 1, there is shown an illustrative ball pitching machine embodying objects and features of the present invention generally designated by the reference numeral 10, which includes main frame 12, having a base portion 14 and main frame brace 16 which is broken away for clarity. Drive housing 18 is mounted to main frame 12 and ball pitching arm 20 extends from drive housing 18 and is rotatable relative thereto, through an arc of approximately 90 degrees which is approximately plus and minus 45 degrees from the vertical position, as best shown in FIG. 2.

Ball storage rack 22 is mounted to main frame 12 adjacent drive housing 18. Ball storage rack 22 is substantially "L"-shaped with ball receiving opening 24 at the top and ball delivery opening 26 at the bottom. A plurality of balls A, B, C and D are shown in ball storage rack 22 in FIG. 1.

Switch bar 28 is shown in the "on" position in FIG. 1 and is located in the bottom portion of drive housing 18 adjacent spider 30. As best shown in FIG. 5, spider 30 is comprised of an actuating arm 32, a ball restraining arm 34 and a switch engaging arm 36 in operative relationship with the switch 28. Spider 30 rotates around pivot pin 38 and is held in engagement with ball A in the ball storage rack by spider restoring spring 40.

Figure 3:
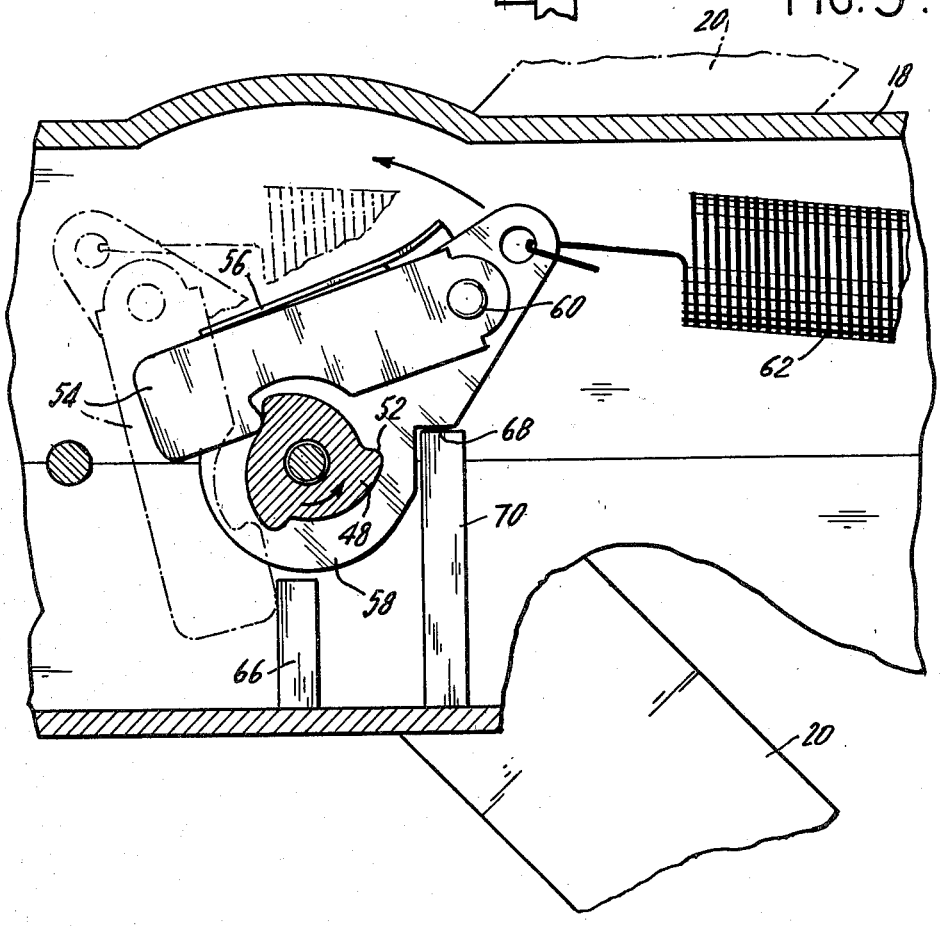
FIG. 3 is an enlarged, partial sectional view taken along the line 3—3 in FIG. 4, looking in the direction of the arrows. The ball pitching arm and associated drive means are shown oriented at the release position by the solid lines and in the cocked position by the phantom lines.

The drive means generally designated by the reference numeral 42, as best shown in FIG. 4, includes an electric motor 44 with an output gear 46 which engages gear train 50 and ultimately rotates drive or ratchet wheel 48 (best shown in FIG. 3).

Referring to FIG. 3, drive or ratchet wheel 48 contains lobes 52 which engage pawl 54. Pawl 54 is pivotably mounted to the eccentric arm 58 about pin 60, and is held in engagement with lobe 52 by flat spring 56 mounted to eccentric arm 58 and urging pawl 54 radially inward at the start of the pitching cycle when ball pitching arm 20 is in the released position shown by the solid lines in FIG. 3. Drive or ratchet wheel 48 causes pawl 54 to rotate in the counterclockwise direction shown in FIG. 3 and the counterclockwise rotation of ratchet wheel 48 is translated to the eccentric arm. The eccentric arm 58 is fastened to the ball pitching arm 20 which in turn rotates with ratchet wheel 48. As ratchet wheel 48 continues to rotate, ball pitching arm 20 moves from the orientation shown by the solid lines in FIG. 3 (the released position) to the cocked position shown by the phantom lines in FIG. 3 and pawl 54 and eccentric arm 58 likewise move to the orientation shown by the phantom lines in FIG. 3.

A pitching spring 62 is fastened between eccentric arm 58 and pin 64 in the drive housing 18. Rotation of drive or ratchet wheel 48 and eccentric arm 58 causes pitching spring 62 to become extended. When ball pitching arm 20 reaches the cocked position, the leading edge of pawl 54 engages release wall 66 causing pawl 54 to disengage from lobe 52 thereby allowing pitching spring 62 to rapidly restore the eccentric arm 58 to the orientation shown by the solid lines in FIG. 3 thereby causing the ball pitching arm 20 to rotate rapidly through an arc of approximately 90° from the orientation shown by the phantom lines in FIG. 2 to the orientation shown by the solid lines therein. At such point, further clockwise rotation of eccentric arm 58 and ball pitching arm 20 (as shown in FIG. 3) is prevented by the engagement of stop 68 of eccentric arm 58 with stop post 70 mounted within drive housing 18. As long as the electric motor 44 is still activated, rachet wheel 48 will continue to rotate in a counterclockwise direction shown in FIG. 3 causing pawl 54 to engage another lobe 52 on rachet wheel 48 and the cycle is repeated.

As best shown in FIG. 4, electric motor 44 obtains electrical power from batteries 72, 72, mounted within drive housing 88. Each battery makes electrical contact with a fixed contact 74 connected to electric motor 44. The other contact of battery 72, 72 engages a through contact 76, 76 mounted in an electrically insulated wall 78 within drive housing 18. Through contacts 76, 76, are normally insulated from each other until the movable contact 80, shown in "off" position in FIG. 4 is caused to slide from the "off" position in a direction parallel to the wall 78 to complete the circuit between through contacts 76, 76. Movable contact 80 is moved by switch bar 28.

The ball pitching machine of the present invention is constructed and arranged so that a plurality of balls A, B, C, D can be pitched consecutively and when the last ball is pitched, the ball pitching machine 10 of the present invention will turn itself off. Specifically, as shown in FIG. 5, when a plurality of balls, A, B, C, D are in ball storage rack 22, the first ball, ball A is maintained at the mouth of ball delivery opening 26 by ball restraining arm 34. As the ball pitching arm 20 (not shown in FIG. 5) moves from the released position to its cocked position, it engages actuating arm 32, rotating it in a counterclockwise direction to the orientation shown by the solid line in FIG. 6. The clockwise rotation of spider 30 causes ball restraining arm 34 to move out of engagement with ball A thereby allowing ball A to move into the pitching orientation shown in FIG. 6 with ball A maintained in the pitching orientation by ball stop 82. Ball A is prevented from moving fore and aft by U-shaped ball holder 84. As ball pitching arm 20 continues to move to the left in FIG. 6, it approaches its point of extreme excursion or cocked position against the restoring force of pitching spring 62. When pawl 54 is caused to release from lobe 52, ball pitching arm 20 is moved rapidly by pitching spring 62, bringing the ball pitching arm into engagement with the ball A thereby causing ball A to be pitched forward or to the right in FIG. 6 as shown by the rightmost phantom line in FIG. 6.

At the moment pawl 54 releases from lobe 52, spider 30 rotates radially outward about pivot pin 38 due to the restoring force of spider restoring spring 40 so that ball restraining arm 34 prevents the second ball, ball B, from entering the ball pitching area. As the rotation of rachet wheel 48 continues causing ball pitching arm 20 to move from its released position to its cocked position past the ball pitching area, spider 30 is again actuated by ball pitching arm 20 allowing ball B to enter the ball pitching area and the cycle is repeated. As long as there is an additional ball in ball storage rack 22, spider 30 is prevented from rotating beyond the orientation shown in FIG. 5 by the interference between ball restraining arm 34 and the next adjacent ball. However, when all balls have been pitched, ball restraining arm 34 will not prevent spider 30 from rotating to the orientation shown in FIG. 7. In such orientation, switch engaging arm 36 engages switch bar 28 thereby translating switch bar 28 from the "on" orientation shown in FIGS. 5 and 6 to the "off" orientation shown in FIG. 7. In the latter orientation, switch bar 28 has been moved from the "on" position to the "off" position thereby interrupting the flow of electrical current from battery 72, 72 to the electric motor 44 causing the ball pitching machine 10 to stop.

In order to repeat the cycle, balls, A, B, C, D are placed in ball storage rack 22 through the ball receiving opening 24 until the first ball engages the ball restraining arm 34 of spider 30 as shown in FIG. 5. At this point, switch bar 28 can be rotated from the "off" position to the "on" position thereby starting the cycle of the ball pitching machine 10.

By constructing the drive or rachet wheel 48 to contain three lobes 52, the amount of rotation of the rachet wheel 48 to engage the pawl 54 is minimized thereby conserving the electrical power.

By minimizing the amount of rotation required in order for the ball pitching arm to move from its released position to the cocked position and back through to the released position thereby completing the pitching cycle, the ball pitching machine of the present invention avoids presenting a hazard when used by children thereby obviating the need for guard rails or similar framing structure. The structure of the present invention is well adapted to economical fabricating techniques. Further, the simple frame structure lends itself to being manufactured in an aesthetically pleasing shape such as a human outline. The simplified structure allows the entire drive means 42 to be enclosed within drive housing 18 avoiding any likelihood of injury to the user.

Likewise, the ball spider which acts as both a ball retainer before and during play is a means of stopping the game when all the balls are used is constructed in such a manner that it can be hidden behind the decorative main frame structure.

Although the invention herein has been described with reference to a particular embodiment, it is to be understood that this embodiment is merely illustrative of the principal and application of the invention. Thus, it is to be understood that numerous modifications may be made in the illustrative embodiment and other arrangements may be devised without departing from the spirit and scope of the invention.

What is claimed is:

1. A ball pitching machine comprising:

a frame;

a drive housing fixedly mounted on said frame;

reciprocating drive means projecting from said drive housing;

a ball pitching arm mounted to said drive means exterior of said housing and movable between a first released position and a second cocked position.

said reciprocating drive means including means wholly within said drive housing for reciprocating said ball pitching arm comprising a rotating drive wheel, an eccentric arm mounted to said ball pitching arm, a pawl pivotably mounted to said eccentric arm engagable with said drive wheel, a release wall mounted in said housing in operative relationship to said pawl, an extension spring connecting said drive housing to said eccentric whereby rotation of said drive wheel moves said pawl and said eccentric from a first released position to a second cocked position wherein the distance between said eccentric and said drive housing is increased so that said extension spring is extended and upon engagement of said pawl with said release wall, said pawl disengages from said drive wheel and said extended extension spring rapidly rotates said eccentric arm and said ball pitching arm mounted to said eccentric arm from said second cocked position to said first released position.

2. The ball pitching machine as recited in claim 1 wherein said ball pitching arm moves between a first release position and a second cocked position through an arc of approximately 90°.

3. The ball pitching arm as recited in claim 1 wherein said reciprocating drive means further includes a flat spring mounted to said eccentric arm and engaging said pawl to maintain said pawl in engagement with said rotating drive wheel until said pawl engages said release wall.

4. The ball pitching machine as recited in claim 1 further including stop means mounted to said housing engaging said eccentric arm when said eccentric arm rotates backward to said first released position.

5. A ball pitching machine as recited in claim 1 further including electric motor means associated with said drive means for rotating said drive wheel and power means associated with said electric motor.

6. A ball pitching machine as recited in claim 5 including switch means interruptably connecting said power means to said electric motor means.

7. A ball pitching machine adapted to pitch at least two balls comprising, a frame including a ball storage rack;

a drive housing fixedly mounted on said frame;

a reciprocating ball pitching arm mounted to said drive housing reciprocating between a first released position and a second cocked position;

ball pitching arm drive means mounted to said frame; an electric motor adapted to be connected to electric power and engaging said drive means;

switch means interruptably connecting electrical power to said electric motor;

ball restraining means mounted to said ball storage rack and comprising a reciprocating spider having an actuating arm engageable with said ball pitching arm, a ball restraining arm engageable with a ball in said ball storage rack and a switch engaging arm engageable with said switch means whereby said switch engaging arm engages said switch means to interrupt electrical power to said electric motor when a ball is not in said ball storage rack.

8. A ball pitching machine as recited in claim 7 wherein said reciprocating ball pitching arm reciprocates through an arc of approximately 90°.

* * * * *